US009339920B2

(12) United States Patent
Barouch et al.

(10) Patent No.: US 9,339,920 B2
(45) Date of Patent: May 17, 2016

(54) JEWELRY TOOL

(71) Applicants: Cathy Barouch, Los Angeles, CA (US); Lara Korhammer, Raby Bay (AU)

(72) Inventors: Cathy Barouch, Los Angeles, CA (US); Lara Korhammer, Raby Bay (AU)

( * ) Notice: Subject to any disclaimer, the term of this patent is extended or adjusted under 35 U.S.C. 154(b) by 254 days.

(21) Appl. No.: 14/228,036

(22) Filed: Mar. 27, 2014

(65) Prior Publication Data

US 2015/0273672 A1 Oct. 1, 2015

(51) Int. Cl.
*B25B 27/00* (2006.01)
*A44C 25/00* (2006.01)
*A44C 27/00* (2006.01)

(52) U.S. Cl.
CPC ..... *B25B 27/00* (2013.01); *A44C 25/007* (2013.01)

(58) Field of Classification Search
CPC ..... B25B 27/00; A44C 27/00; A44C 25/007
See application file for complete search history.

(56) References Cited

U.S. PATENT DOCUMENTS 2,571,819 A * 10/1951 Boel ..... B25B 7/02 29/517
2,603,849 A * 7/1952 Epperson ..... D06F 55/00 24/507
2,618,994 A * 11/1952 Frazee ..... A01K 95/02 7/132
2,629,114 A * 2/1953 Peterson ..... B25C 11/02 254/22
2,653,332 A * 9/1953 Precious ..... A01K 95/02 29/517
2,753,741 A * 7/1956 Riley ..... A01K 95/02 7/106
2,797,019 A * 6/1957 Larson ..... B67B 7/40 220/284
2,961,670 A * 11/1960 Frame ..... A01K 97/00 289/17
3,172,319 A * 3/1965 Stanfield ..... A01K 95/02 29/517
3,597,775 A * 8/1971 McCasland ..... A01K 95/02 7/106
3,641,654 A * 2/1972 Wheeler ..... A01K 95/02 29/34 R
4,057,863 A * 11/1977 Bewley ..... B25B 7/22 7/106
4,796,318 A * 1/1989 Bigej ..... A01K 95/02 7/106
5,557,874 A * 9/1996 Pietrandrea ..... A01K 97/00 289/17
7,010,880 B1 * 3/2006 Meiseles ..... A01K 97/00 43/4
7,013,594 B1 * 3/2006 Meiseles ..... A01K 97/00 43/4
7,254,854 B2 * 8/2007 Yonenoi ..... A01K 97/00 30/143

* cited by examiner

*Primary Examiner* — David B Thomas
(74) *Attorney, Agent, or Firm* — Omni Legal Group; Omid E. Khalifeh

(57) ABSTRACT

A handheld charm opener having a cheliform charm-opening body comprising an upper and lower piece, each with at least one protrusion oriented vertically but aligned horizontally and inserted into closed bracelet charm, and through manual compression of the apparatus between the thumb and forefinger, the protrusions traveling towards one another through translational vertical motion while engaging with the opening of the charm until the charm halves split apart revealing the center portion inside, the arcs of the protrusions protecting the charm from being damaged.

6 Claims, 3 Drawing Sheets

JEWELRY TOOL

CROSS-REFERENCE TO RELATED APPLICATIONS

None

BACKGROUND

The following is a tabulation of some prior art that presently appears relevant:

U.S. Patents

| Pat. No. | Kind Code | Issue Date | Patentee |
|---|---|---|---|
| 5,403,230 | A | Apr. 4, 1995 | Capriglione, Sr. |
| 7,112,129 | B2 | Sep. 26, 2006 | Zimbone, et. al. |
| 7,361,080 | B2 | Apr. 22, 2008 | Martin |
| 7,784,383 | B2 | Aug. 31, 2010 | Salva, et. al. |
| 7,806,028 | B2 | Oct. 5, 2010 | Yue |
| 7,976,365 | B1 | Jul. 12, 2011 | King |
| 8,387,260 | B2 | Mar. 5, 2013 | Quentin |
| 8,438,951 | B1 | May 14, 2013 | McCabe, et. al. |
| 8,484,785 | B1 | Jul. 16, 2013 | Kristiansen, et. al. |

U.S. Patent Application Publications

| Publication Number | Kind Code | Publ. Date | Applicant |
|---|---|---|---|
| 2013/0124301 | A1 | May 16, 2013 | Bachman |

Foreign Patent Document

None Found

Nonpatent Literature Documents

None Found

NOTICE OF COPYRIGHT AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

BACKGROUND

1. Field of the Invention

The present disclosure relates to aids for the wearing of jewelry and in particular to aids for the fastening and unfastening of jewelry connectors and removing decorative charms such as locked charms and safety chain locks from charm bracelets.

2. Discussion of the Related Art

Decorative charms such as locked charms and safety chain locks, once installed onto a bracelet, are held securely in place by a firm compression member. These types of jewelry pieces are also commonly referred to as European chains or European Charm Bracelets. Given the often high value attributed to these charms, the compression member is designed to prevent accidents by making it very difficult for the charm to be opened and thereby removed from the charm bracelet. To further reduce the risk that valuable charms will get accidentally lost, many bracelets are fitted with safety chains and locks as well. Moreover, jewelry such as necklaces, anklets and bracelets frequently have connectors that are difficult to grasp, easily retain in an open position and securely latch. This may be attributed to the fine delicate nature of many of these pieces of jewelry, but the jewelry latching process is further complicated by the limitations of the fastener and/or wearer to successfully manipulate and fasten the connectors of the piece of jewelry.

By way of example, fastening a typical "lobster claw" or spring ring type clasp requires the manipulation of a small lever that extends from the annular ring of the clasp to actuate to the opening and closing of the clasp. The lever can be difficult to visually or tactilely find, manipulate and retain in an open position against the bias of the clasp. The fastener then has to place the opposing connector of the piece of jewelry into the narrow opening of the clasp and release the lever to fasten the connectors together.

The difficult processes for fastening the clasp and splitting open a charm to add or remove it from a charm bracelet can be increased by the inability of the fastener to see, align, and fasten the connectors of the jewelry together. Opening a charm by hand is practically impossible. The narrow opening of the charm is so fine that a finger nail could barely fit in let alone travel the length of the charm exterior to reach the compression member deep within. These difficulties attributed to charm bracelets have caused many wearers to attempt latching the connectors by trial and error and split open the charm by using means that may damage the charm and bracelet. This can be sufficiently frustrating and harmful when a user resorts to commonly available pointed objects such as knives and needles to open their charms.

While aids have been developed to assist in opening and removing charms from a charm bracelet and the fastening of the connectors of pieces of jewelry, none provide the ease of use and flexibility that many user's demand. An aid for safely opening a decorative charm and spring type jewelry connectors without damaging these jewelry items is needed. The present invention effectuates these needs.

SUMMARY

The object of the present invention is to provide an economical hand operated device, which assists opening common ornamental charms such as locked charms and safety chain locks. The current invention shall be compact, safe, durable, comprised of standard materials, and readily manufacturable. The body of the current invention is comprised of two primary arm pieces pivotally attached to one another to form a v-shape. The two arms are connected to each other at one end to form a connected end, and start to open from the connected end.

The invention comprises several projections, at least one of which is arcuate, designed to hold a charm securely in place while the present invention is used to pry it open. The shape and spacing of the projections allows for flexibility in the shape and size of the charms the opener of the present invention may be used to open. Inserted into the shape of one of the primary pieces is at least one hardened edge comprising a pointed tip to facilitate opening without causing damage to the charm which may be an expensive piece of jewelry.

In one embodiment of the present invention, a spring member biases the first end of the first arm and the second arm in a general direction away from each other. Upon maneuvering the first end of the first arm and the second arm in a general direction toward each other, the second end of the first arm and the second arm also move in a general direction toward each other. Upon the second end of the first arm and the second arm being maneuvered together, an inside surface of the first arm rests completely against an inside surface of the second arm.

One end of the second arm comprises an outer arcuate section which further comprises a point which is oriented to provide significant mechanical advantage holding a charm in place while the jewelry tool of the present invention is in use. The second arm further comprises and indented cavity for the chain of the safety chain locks to rest in while the tool of the present invention is in use. This cavity is designed to prevent damage which may otherwise be incurred when the tool is being engaged. The tool of the current invention eliminates issues plaguing presently available openers and offers more utility while allowing it to be manufactured from a variety of materials.

These and other advantages of one or more aspects will become apparent from consideration of the ensuing description and accompanying drawings. Although the description above contains many specificities, these should not be construed as limiting the scope of the embodiments but as merely providing illustrations of some of several embodiments. Thus the scope of the embodiments should be determined by the claims that are appended and their legal equivalents, rather than by the examples given.

The description of the invention which follows, together with the accompanying drawings should not be construed as limiting the invention to the example shown and described, because those skilled in the art to which this invention pertains will be able to devise other forms thereof within the ambit of the appended claims.

DESCRIPTION OF THE DRAWINGS

For a more complete understanding of the present disclosure, reference is now made to the following brief description, taken in connection with the accompanying drawing, reference numerals, and detailed description.

Figure 1:
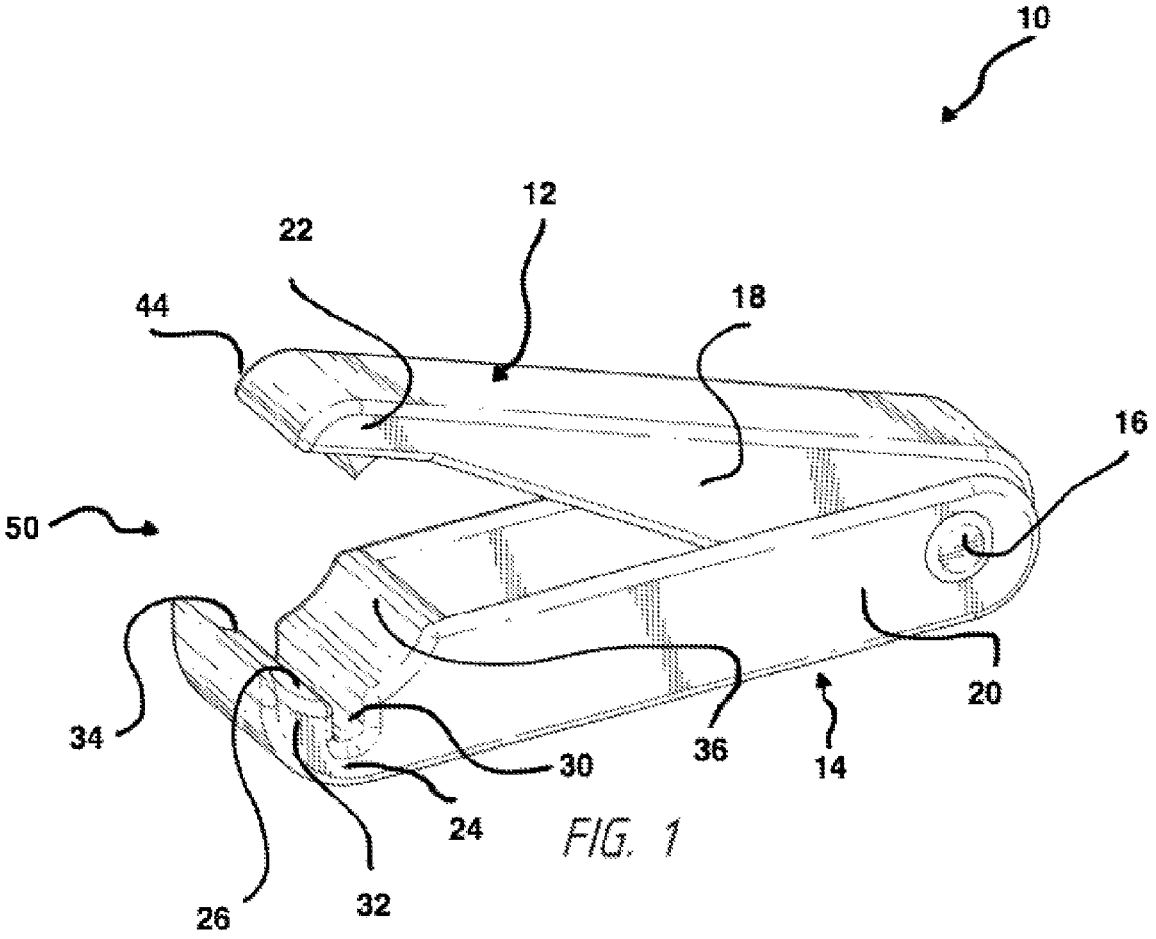
FIG. 1 is a front perspective view of a jewelry tool according to the present invention.

In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, in various embodiments the invention provides numerous advantages over the prior art. However, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

Finally, reference is made to a "charm opener" and "decorative charms" by way of example and not by limitation. The jewelry tool of the present invention may also be used to open all chains on bracelets, necklaces, and anklets. Moreover, it is known in the art to refer to "decorative charms" as "locked charms" or simply "locks." It is also well known in the art to refer to charm bracelets as "European charm bracelets" and "European chains." Accordingly, the examples provided below are not intended to limit the scope of the invention but rather to illustrate embodiments of the invention.

DETAILED DESCRIPTION

Illustrative embodiments of the invention are described below. The showings are for purposes of illustrating preferred embodiments and not for purposes of limiting the same. The following explanation provides specific details for a thorough understanding of an enabling description for these embodiments. One skilled in the art will understand that the invention may be practiced without such details. In other instances, well-known structures and functions have not been shown or described in detail to avoid unnecessarily obscuring the description of the embodiments.

Figure 2:
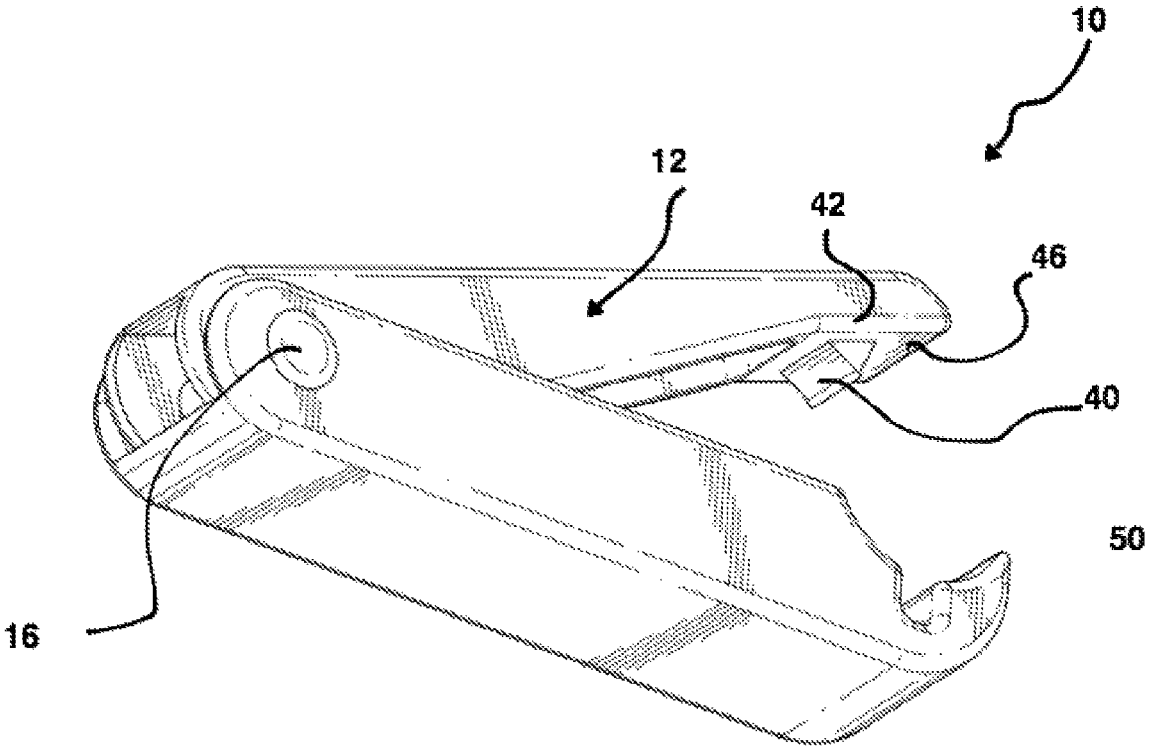
FIG. 2 is a rear perspective view of a jewelry tool according to the present invention.
Figure 3:
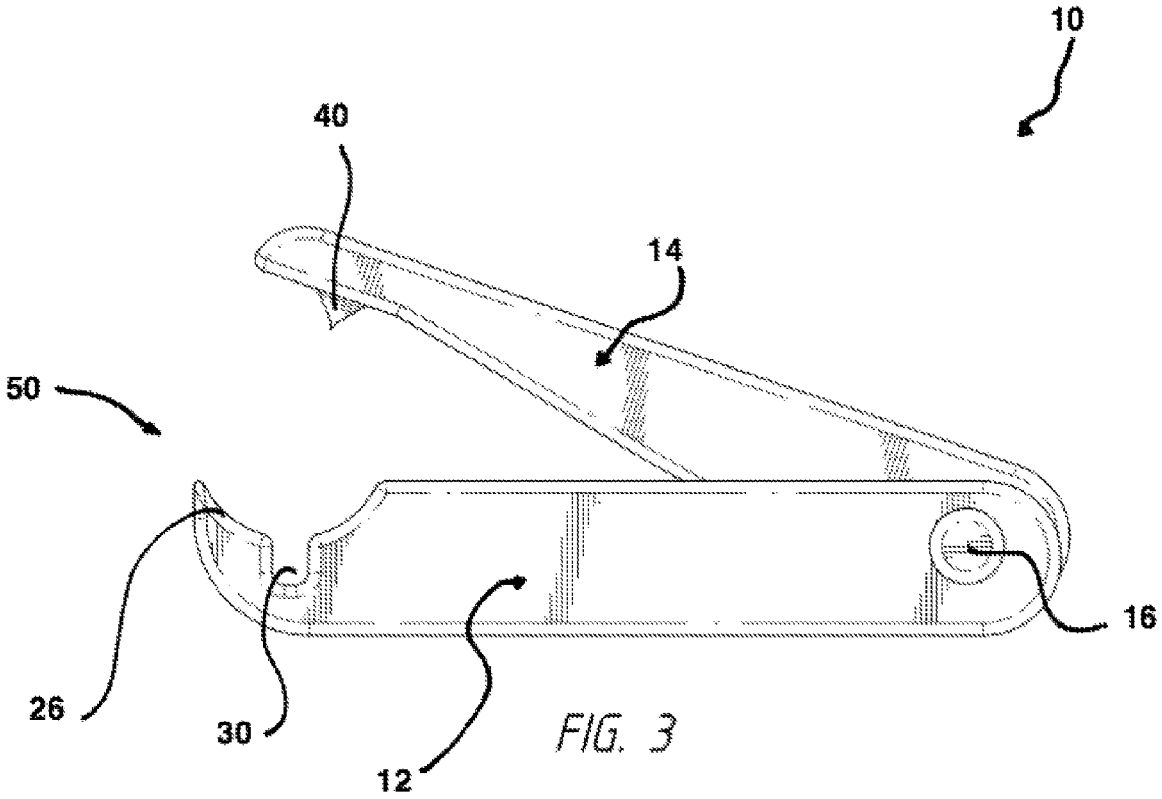
FIG. 3 is a profile view of a jewelry tool according to the present invention.

Turning now to FIG. 1-3 for more detail, numeral 10 designates the jewelry tool apparatus for opening decorative charms, locked charms, safety chains as well as clasps, of the present invention. The apparatus 10 comprises a pair of pivotally connected, closely spaced, finger-compression members 12 and 14. Each finger-compression member 12 and 14 comprises a handle portion 18, 20, respectively, and a head portion 22, 24, respectively. The top handle portions 18 is slightly narrower than the bottom handle portion 20 extending a distance from each other along a major part of the longitudinal axis thereof so that one handle portion 18 can fit inside the second handle portion 20 in a nesting fashion when the two handles 18 and 20 are pressed together. In one embodiment, the exterior surface of the handle portions 18 and 20 may have a friction-increasing cover to facilitate gripping of the handle portions by the user.

The head portions 22, 24 are integrally formed with their respective compression member 12 and 14. A pivot point 16, which in one embodiment may comprise a pin member, is inserted through corresponding openings formed in the handle portions 18 and 20, thereby allowing pivotal movement between the compression members 12 and 14. In one embodiment, a reinforced spring (not shown) pivotally interconnects finger-compression members 12 and 14. The reinforced spring further operationally interconnects finger-compression members 12 and 14 passing through the pivot point 16 providing sufficient resistance to maintain the compression members 12 and 14 in a v-shape when they are not compressed by a user.

The apparatus 10 of the present invention also includes a substantially cheliform charm-opening body 50. One head portion 24 is provided with a concave inner surface 26. A groove 30 is formed in the surface 26 extending from one side 32 to the second side 34 of the head portion 24. The surface 26 is concave in shape such that a charm or other object to be opened can be contained between the curvatures extending from one side 32 to the second side 34 of the head portion 24. This inner surface 26 removably receives a charm or portion thereof therein. In one embodiment, this surface 26 may comprise serrations 36. The serrations 36 also serve to anchor a charm, or other item to be opened, while preventing it from sliding around throughout the process of opening the charm.

The groove 30 forms an indented cavity such that the chain of a safety chain lock may rest therein while the apparatus 10 of the present invention is in use. The groove 30 is designed to prevent damage which may otherwise be incurred while the apparatus 10 is being engaged.

One head portion 22 is provided with a prying member 40 (see FIG. 2). The prying member 40 is formed in the surface extending from one side 42 to the second side 44 (FIG. 1) of the head portion 22. In one embodiment of the apparatus 10, the head portion 22 with the prying member 40 may be serrated. The serrations 46 also serve to anchor for the charm and prevent it from sliding around while the apparatus 10 is in use.

As illustrated more clearly in FIG. 2, the inner edge of the first compression member 12 has an angular cutting edge 40 also referred to as the prying member. The angular cutting edge 40 is shown defining an angle of about forty-five (45) degrees, but it should be understood that these angle dimensions are for illustration purposes only, and it is not necessary that the cutting edge 40 be angled at forty-five degrees. The cutting edges 40 may be configured at any suitable angle that provides the edges 40 and with a sharp structure so that they can split a decorative charm and safety chain lock or open the clasp on a piece of jewelry without causing any damage to any of them.

The pivot point 16 allows the handle portions 18, 20 and the head portions 22, 24 move towards and away from each other. The length of the handle portions 18 and 20 is selected to be comfortable for a user to grip using his or her thumb and index finger while remaining able to exercise a reasonable degree of control over the pivotal movement of the head portions 22, 24 so as to press down on decorative charms, safety chains or clasp with enough force to open it without causing any damage.

As described previously, the jewelry tool apparatus 10 is biased to the open position wherein first compression member 12 and second compression member 14 meet at one point around the pivot point 16 to form a v-shape. In one embodiment, the pivot point 16 comprises a bias member that coils around a pin (not shown) and has terminal end portions that urge the compression members 12 and 14 away from the central longitudinal axis-X. The bias member, however, can be any form of resilient energy storage device that provides a suitable displacing force to urge compression members 12 and 14 to the open position such as leaf springs or a resilient polymer structure, for example.

In use, a person positions the handle portions 18 and 20 with one hand, between the thumb and index fingers. The shape and size of the prying member 40 is selected to fit within the grove of a decorative charm such as those commonly found on charm bracelets. In use, the charm may rest above the concave inner surface 26 with the grove facing upwards towards the prying member 40. The user then manipulates the handle portions 18, 20 relative to the charm so that it is split or along the grove, which is a substantially continuous line. When force is applied to the handle portions 18 and 20, it will cause the prying member to be inserted into the charm's grove between the two sides of the charm and compress the member linking them together. This will cause the charm to open.

The user can easily stop the squeezing motion on the handle portions 18, 20 as soon as the user detects that the charm has been opened. Since the charm would offer a different level of resistance once the linking member had been compressed, the user can prevent damage to the charm by terminating the squeezing action on the handle portions 18, 20.

In one embodiment, a contoured thumb rest member (not shown) may be disposed on an upper edge of the handle portions 18, 20. The thumb rest member may be formed of a pair of rounded spaced apart protrusions disposed therebetween. The indentation between the protrusions may be formed to accommodate a user's thumb and index finger therein.

Although the invention has been described with reference to specific embodiments, it will be understood by those skilled in the art that various changes may be made without departing from the scope of the invention. Accordingly, the disclosure of embodiments is intended to be illustrative of the scope of the invention and is not intended to be limiting. It is intended that the scope of the invention shall be limited only to the extent required by the appended claims. To one of ordinary skill in the art, it will be readily apparent that the devices and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents

CONCLUSIONS, RAMIFICATIONS, AND SCOPE

While a particular form of the invention has been illustrated and described, it will be apparent that various modifications can be made without departing from the spirit and scope of the invention. For example, the jewelry tool may be describe as opening a decorative charm even though the inventor contemplates the possibilities of using the jewelry tool for opening a variety of other decorative items that need to be pried open such as the safety clasp of a charm bracelet. Accordingly, is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Particular terminology used when describing certain features or aspects of the invention should not be taken to imply that the terminology is being refined herein to be restricted to any specific characteristics, features, or aspects of the jewelry tool with which that terminology is associated. In general, the terms used in the following claims should not be constructed to limit the jewelry tool to the specific embodiments disclosed in the specification, unless the above description section explicitly define such terms. Accordingly, the actual scope encompasses not only the disclosed embodiments, but also all equivalent ways of practicing or implementing the disclosed system. The above description of embodiments of the jewelry tool is not intended to be exhaustive or limited to the precise form disclosed above or to a particular field of usage. While specific embodiments of, and examples for, the tool are described above for illustrative purposes, various equivalent modifications are possible which those skilled in the relevant art will recognize.

While certain aspects of the jewelry tool are presented below in particular claim forms, the inventors contemplate the various aspects of the system in any number of claim forms. Accordingly, the inventors reserve the right to add additional claims after filing the application to pursue such additional claim forms for other aspects of the jewelry tool.

What is claimed is:

1. An apparatus for opening a decorative charm, comprising:

a first rigid member having a first handle portion and a first head portion secured to said first handle portion;

a second rigid member having a second handle portion and a second head portion secured to said second handle portion, said first rigid member being pivotally connected to said second rigid member;

wherein said first head portion comprises a downward facing pyramidal prying blade and said second head portion comprises a concave shape for engaging a decorative charm therebetween and splitting open said charm; further comprising a pivot pin, which extends through respective openings formed in the first rigid member opposite the head portion and the second rigid member opposite the head portion;

wherein said pivot pin includes a bias member.

2. The apparatus of claim 1 wherein the bias member urges said first head portion and said second head portion apart.

3. The apparatus of claim 1 wherein said first head portion further comprises serrations for engaging said charm and holding it securely in place while being split.

4. An apparatus for opening a decorative charm, comprising:

a first rigid member having a first handle portion and a first head portion secured to said first handle portion;

a second rigid member having a second handle portion and a second head portion secured to said second handle portion, said first rigid member being pivotally connected to said second rigid member;

a pivot pin, which extends through respective openings formed in the first rigid member opposite the head portion and the second rigid member opposite the head portion;

said pivot pin comprising a bias member wherein the bias member urges said first head portion and said second head portion apart; and wherein said first head portion comprises a downward facing pyramidal prying blade and said second head portion comprises a concave shape for engaging a decorative charm there between and splitting open said charm.

5. The apparatus of claim 4 wherein said first head portion further comprises serrations for engaging said charm and holding it securely in place while being split.

6. A method of opening a decorative charm, comprising the steps of:

providing a first rigid member having a first handle portion and a first head portion secured to said first handle portion;

providing a second rigid member having a second handle portion and a second head portion secured to said second handle portion, said first rigid member being pivotally connected to said second rigid member providing a pivot pin, which extends through respective openings formed in the first rigid member opposite the head portion and the second rigid member opposite the head portion;

said pivot pin comprising a bias member wherein the bias member urges said first head portion and said second head portion apart; and wherein said first head portion comprises a downward facing pyramidal prying blade and said second head portion comprises a concave shape for engaging a decorative charm therebetween and splitting open said charm;

positioning a decorative charm with a small opening comprising compression member therein, between said first head portion and said second head portion;

moving said first rigid member and said second rigid member towards each other, thereby causing said prying blade to contact said charm opening, moving said compression member and prying open the two sides of said charm without imparting substantial mechanical damage to said charms exterior.

* * * * *